US006513729B2

(12) United States Patent
Ochiai et al.

(10) Patent No.: US 6,513,729 B2
(45) Date of Patent: Feb. 4, 2003

(54) TWO-PACKAGE-MIXING DISCHARGING DEVICE AND TWO-PACKAGE-MIXING COATING DEVICE

(75) Inventors: Hiroshi Ochiai, Utsunomiya (JP); Hiroyoshi Nozaki, Utsunomiya (JP); Hidenori Taguchi, Utsunomiya (JP); Shinobu Tokin, Utsunomiya (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/933,951

(22) Filed: Aug. 22, 2001

(65) Prior Publication Data

US 2002/0023971 A1 Feb. 28, 2002

(30) Foreign Application Priority Data

Aug. 29, 2000 (JP) ..... 2000-259720
Oct. 2, 2000 (JP) ..... 2000-302682
Oct. 13, 2000 (JP) ..... 2000-314087

(51) Int. Cl.[7] ..... B67D 5/52

(52) U.S. Cl. ..... 239/223; 239/700; 239/703; 222/135

(58) Field of Search ..... 222/135, 263, 222/148; 239/223, 224, 700, 701, 703

(56) References Cited

U.S. PATENT DOCUMENTS 4,154,368 A * 5/1979 Gusmer et al. ..... 222/135
4,572,437 A * 2/1986 Huber et al. ..... 239/223
5,078,321 A * 1/1992 Davis et al. ..... 239/703
5,820,036 A * 10/1998 Saito ..... 239/703
5,909,849 A * 6/1999 Yamasaki et al. ..... 239/700

FOREIGN PATENT DOCUMENTS

| | | | |
|---|---|---|---|
| EP | 0 163 588 A1 | | 4/1985 |
| JP | 6-262053 | | 9/1994 |
| JP | 6-294379 | | 10/1994 |
| JP | Y2-506381 | * | 5/1996 |
| JP | 9-75789 A | | 3/1997 |
| JP | 2000-126654 A | | 5/2000 |
| JP | A2000126654 | * | 5/2000 |

* cited by examiner

*Primary Examiner*—Philippe Derakshani
(74) *Attorney, Agent, or Firm*—Birch, Stewart, Kolasch & Birch, LLP

(57) ABSTRACT

A base compound supply passage and a hardener supply passage supply a base compound and a hardener, respectively, fed under pressure from first and second color changing valve mechanisms to a coating gun. The base compound supply passage and the hardener supply passage have respective first and second gear pumps, and first and second pressure control valves for controlling the base compound and the hardener to be supplied under given pressures to the first and second gear pumps. Two liquids, i.e., the base compound and the hardener, can be supplied reliably at desired rates to the coating gun, and mixed and discharged at a desired mixing ratio.

10 Claims, 7 Drawing Sheets

TWO-PACKAGE-MIXING DISCHARGING DEVICE AND TWO-PACKAGE-MIXING COATING DEVICE

BACKGROUND OF THE INVENTION

1. Field of the Invention

The present invention relates to a two-package-mixing discharging device having a discharger for being supplied with two liquids individually fed under pressure and discharging a mixture of the liquids, and a two-package-mixing coating device for individually supplying a base compound and a hardener to respective passages in a dual-tube nozzle in a rotary atomizing head, mixing the base compound and the hardener with each other, and atomizing and discharging the mixture toward an object to be coated.

2. Description of the Related Art

There has been used a two-package-mixing coating (discharging) device for mixing a base compound and a hardener with each other and discharging the mixture to coat an object such as an automotive body or the like. One known two-package-mixing supplying device as such a two-package-mixing coating device is disclosed in Japanese utility model registration publication No. 2506381, for example.

The disclosed two-package-mixing supplying device will be described below with reference to FIG. 7 of the accompanying drawings.

As shown in FIG. 7, a base compound X and a hardener Y are stored in respective reservoir tanks 1*a,* 1*b* in which there are disposed ends of respective pressure-feed passages 2*a,* 2*b.* The pressure-feed passages 2*a,* 2*b* have other ends connected to respective inlet ports of a mixer 3 whose outlet port is connected to a coating gun 4. Gear pumps 5*a,* 5*b* are connected respectively in the pressure-feed passages 2*a,* 2*b.* The gear pump 5*a* is connected to an air motor 8 by a speed reducer 6, and the gear motor 5*b* is connected to the air motor 8 by a speed changer 7.

For setting a mixing ratio for the base compound X and the hardener Y, the speed changer 7 is used to adjust the rotational speed of the gear pump 5*b* for delivering the hardener Y. Then, the air motor 8 is energized to rotate at a predetermined rotational speed, operating the gear pumps 5*a,* 5*b* to supply the base compound X and the hardener Y respectively from the reservoir tanks 1*a,* 1*b* to the mixer 3 at a given rate. The base compound X and the hardener Y are mixed with each other by the mixer 3, and the mixture is supplied to the coating gun 4, from which the mixture is applied to an object to be coated (not shown).

Since the main compound X and the hardener Y are supplied from the reservoir tanks 1*a,* 1*b* directly to the gear pumps 5*a,* 5*b,* the amounts of the main compound X and the hardener Y that are discharged from the gear pumps 5*a,* 5*b* tend to vary depending on variations in the pressures which are usually applied to deliver the main compound X and the hardener Y from the reservoir tanks 1*a,* 1*b* in the coating site. When the discharged amounts of the main compound X and the hardener Y vary, the mixing ratio for the base compound X and the hardener Y in the mixer 3 also varies, causing properties, such as color, hardness, etc. of the coating on a coated object such as an automotive body to be unstable. Therefore, the properties of the produced coating fail to be uniform.

Another known two-package-mixing coating device is disclosed in Japanese laid-open patent publication No. 2000-126654, for example.

As shown in FIG. 8 of the accompanying drawings, the disclosed two-package-mixing coating device has a coating machine 1*c* comprising an inner tube 2*c,* an outer tube 3*c* disposed coaxially around the inner tube 2*c,* a rotatable shaft 4*c* disposed coaxially around the outer tube 3*c,* a bell cup 5*c* mounted on the tip end of the shaft 4*c,* and a lid 6*c* mounted on the tip end of the bell cup 5*c.* The inner tube 2*c* is supplied with a base compound 7*c,* and the space between the inner tube 2*c* and the outer tube 3*c* is supplied with a hardener 8*c.*

When the bell cup 5*c* is rotated at a high speed by an air motor or the like, the base compound 7*c* supplied to the inner tube 2*c* and the hardener 8*c* supplied to the space between the inner tube 2*c* and the outer tube 3*c* are mixed into a coating mixture, which is discharged as an atomized mist from a gap 9*c* between the bell cup 5*c* and the lid 6*c* and applied to an object to be coated.

The base compound 7*c* and the hardener 8*c* are individually supplied to the bell cup 5*c* while being isolated from each other by the dual-tube structure. The base compound 7*c* is introduced from the inner tube 2*c* into the bell cup 5*c* in the direction indicated by the arrow H, whereas the hardener 8*c* is introduced from the space between the inner tube 2*c* and the outer tube 3*c* into the bell cup 5*c* in the direction indicated by the arrow H. Inasmuch as the base compound 7*c* and the hardener 8*c* are injected into the bell cup 5*c* in the same direction, the base compound 7*c* and the hardener 8*c* may possibly fail to blend sufficiently with each other even though they are guided along the inner shape of the lid 6*c.* When the base compound 7*c* and the hardener 8*c* do not blend sufficiently with each other, the mixed state of the base compound 7*c* and the hardener 8*c* tends to vary, resulting in unstable properties of the produced coating.

The base compound 7*c* is less liable to change its viscosity upon exposure to air and water. However, the hardener 8*c* quickly hardens when it contacts air and water. Therefore, the hardener 8*c* tends to be deposited and hardened on the tip end 2*d* of the inner tube 2*c.* If a hardened deposit exists on the tip end 2*d* of the inner tube 2*c,* then it causes a change in the discharged amount and direction of the hardener 8*c,* making properties of the produced coating unstable.

With the disclosed two-package-mixing coating device shown in FIG. 8, because the base compound 7*c* and the hardener 8*c* are individually supplied to the bell cup 5*c* while being isolated from each other by the dual-tube structure, the base compound 7*c* and the hardener 8*c* start to be mixed with each other only after they are discharged into the bell cup 5*c.* However, no attempt is made to design the bell cup 5*c* to improve the mixed state of the base compound 7*c* and the hardener 8*c,* e.g., to specify the distance T from the lid 6*c* to the tip end of the bell cup 5*c.* Therefore, the base compound 7*c* and the hardener 8*c* are uncontrollably mixed with each other. As a result, the base compound 7*c* and the hardener 8*c* may not be mixed sufficiently with each other, causing properties, such as color, hardness, etc. of the produced coating to be unstable.

SUMMARY OF THE INVENTION

It is a general object of the present invention to provide a two-package-mixing discharging device which is of a simple structure capable of mixing two liquids individually fed under pressure reliably at a desired mixing ratio.

A major object of the present invention is to provide a two-package-mixing coating device which is of a simple structure capable of mixing a base compound and a hardener reliably in a desired mixed state for effectively improving properties of a produced coating.

A two-package-mixing discharging device according to the present invention has first and second liquid supply passages for supplying first and second liquids fed under pressure from respective first and second liquid supplies to a discharger. The first and second liquid supply passages have first and second gear pumps for delivering the first and second liquids under pressure to the discharger, and liquid pressure control means disposed upstream of the first and second gear pumps.

The liquid pressure control means are capable of controlling the first and second liquids to be supplied to the first and second gear pumps, respectively, under respective predetermined pressures. The first and second gear pumps can thus discharge the first and second liquids at stable rates, so that the first and second liquids can be mixed with each other reliably at a desired mixing ratio.

A two-package-mixing coating device according to the present invention has a dual-tube nozzle disposed in a rotary atomizing head and having an outer tube and an inner tube extending in the outer tube, for individually supplying a base compound and a hardener. The inner tube is arranged to emit a liquid at a liquid emission angle greater than a liquid emission angle for liquid emission from a space between the inner tube and the outer tube.

The base compound and the hardener emitted from the dual-tube nozzle can be aerially mixed with each other and supplied into the rotary atomizing head. The base compound and the hardener are mixed in an effectively improved mixing state. The mixture of the base compound and the hardener which is atomized and discharged from the rotary atomizing head is reliably maintained at a desired mixing ratio, thus producing a high-quality coating on an object to be coated. Since only the liquid emission angles need to be set to desired values, the overall structure of the two-package-mixing coating device is not complex and is economical.

Another two-package-mixing coating device according to the present invention has a dual-tube nozzle disposed in a rotary atomizing head and having an outer tube and an inner tube extending in the outer tube, for individually supplying the base compound and the hardener, and a lid disposed in the rotary atomizing head and defining a coating liquid dispersion opening, the dual-tube nozzle having a tip end which is open in the coating liquid dispersion opening. The rotary atomizing head has a tip end spaced from the lid by a distance L (mm) along an inner surface configuration of the rotary atomizing head, the rotary atomizing head being rotatable at a rotational speed N (rpm), the product L×N of the distance L and the rotational speed N being in a range from 400,000 to 900,000.

If the product L×N were less than 400,000 when the rotational speed N is in the range from 20,000 rpm to 30,000 rpm, the distance L would be too small, causing the base compound and the hardener to be mixed irregularly and tending to develop color and hardness irregularities in the produced coating on the object. Conversely, if the product L×N were greater than 900,000 when the rotational speed N is in the range from 20,000 rpm to 30,000 rpm, the distance L would be too large, causing the base compound and the hardener to be dried and tending to lower the efficiency with which they are deposited on the object and bring about discolorations.

With the rotational speed N and the distance L set in the ranges described above, the mixing state of the base compound and the hardener is effectively improved, and the mixture of the base compound and the hardener is atomized and discharged at a desired mixing ratio to the object to be coated, efficiently producing a high-quality coating on the object. The two-package-mixing coating device is not complex in structure and is economical.

The above and other objects, features, and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
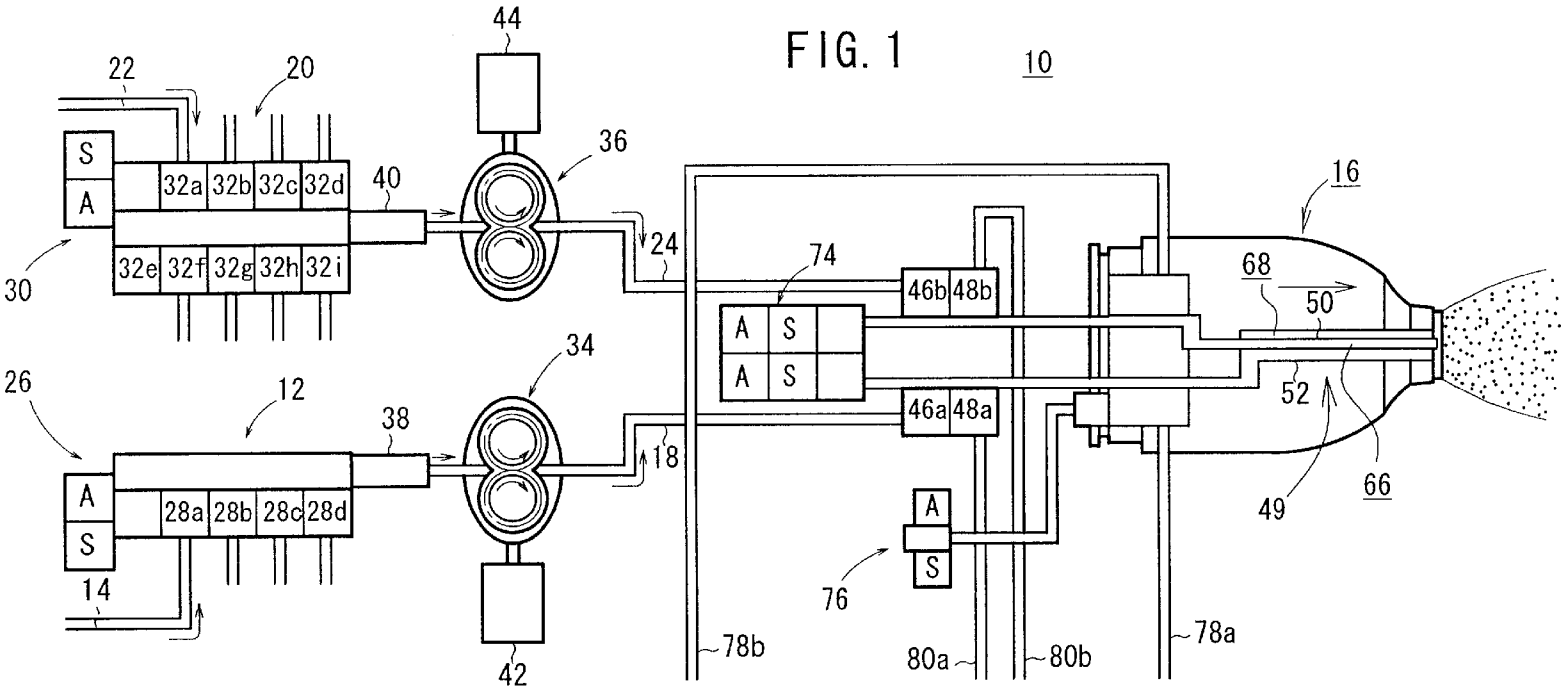
FIG. 1 is a schematic view of a two-package-mixing coating device according to a first embodiment of the present invention.

FIG. 1 schematically shows a two-package-mixing coating (discharging) device 10 according to a first embodiment of the present invention.

As shown in FIG. 1, the coating device 10 has a base compound supply passage (first liquid supply passage) 18 for supplying a base compound (first liquid) 14 fed under pressure from a first color changing valve mechanism (first liquid supply) 12 to a coating gun 16 as a discharger, and a hardener supply passage (second liquid supply passage) 24 for supplying a hardener (second liquid) 22 fed under pressure from a second color changing valve mechanism (second liquid supply) 20 to the coating gun 16.

The first color changing valve mechanism 12 comprises a first cleaning valve 26 for controlling the supply of air (A) and a cleaning liquid (S), and a plurality of control valves 28*a* through 28*d* for supplying base compounds 14 corresponding to coating liquids of different colors. Similarly, the second color changing valve mechanism 20 comprises a second cleaning valve 30 for controlling the supply of air (A) and a cleaning liquid (S), and a plurality of control valves 32*a* through 32*i* for supplying hardeners 22 corresponding to coating liquids of different colors. The control valves 28*a* through 28*d*, 32*a* through 32*i* are connected to base compound reservoirs and hardener reservoirs (not shown) respectively through pressurizing pumps (not shown). The coating liquids, i.e., the base compounds 14 and the hardeners 22, are supplied under pressure to the control valves 28*a* through 28*d*, 32*a* through 32*i* by the pressurizing pumps.

The base compound supply passage 18 and the hardener supply passage 24 have respective first and second gear pumps 34, 36 for delivering each of the base compounds 14 and each of the hardeners 22 under pressure to the coating gun 16, and respective first and second pressure control valves (liquid pressure control means) 38, 40 disposed respectively upstream of the first and second gear pumps 34, 36, for controlling the base compound 14 and the hardener 22 to be fed under predetermined pressures to the first and second gear pumps 34, 36. First and second servomotors 42, 44 are connected to the first and second gear pumps 34, 36, respectively.

Trigger valves 46*a*, 46*b* and drain valves 48*a*, 48*b* are connected to outlet ports of the base compound supply passage 18 and the hardener supply passage 24. The coating gun 16 houses a dual-tube nozzle 49 comprising an inner tube 50 and an outer tube 52 which are openably and closably connected to the base compound supply passage 18 and the hardener supply passage 24 respectively by the trigger valves 46*a*, 46*b*.

Figure 2:
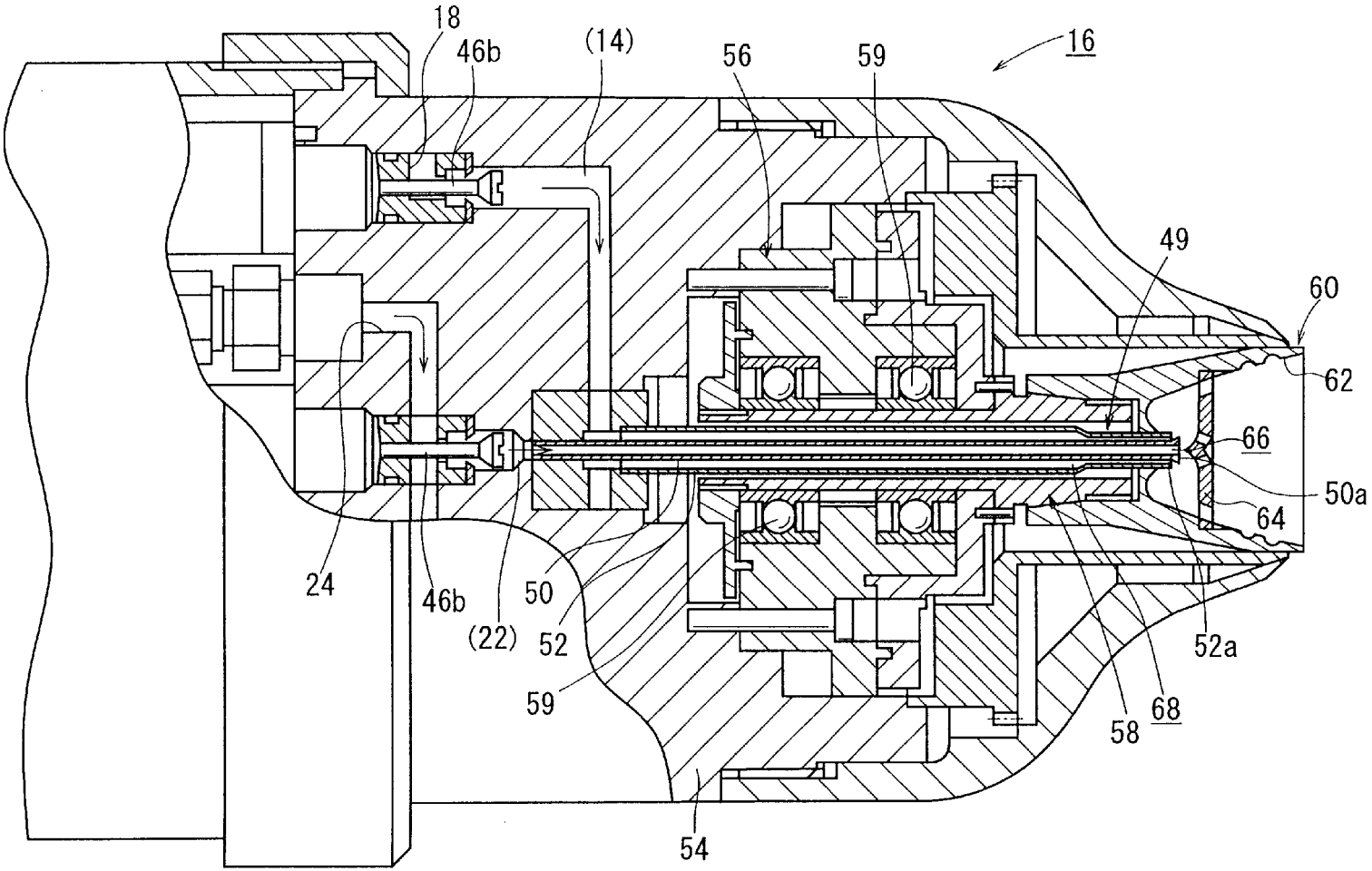
FIG. 2 is a fragmentary cross-sectional view of a coating gun of the two-package-mixing coating device shown in FIG. 1.

As shown in FIG. 2, the coating gun 16 has an air motor 56 housed in a casing 54 and a tubular rotatable shaft 58 rotatably supported in the casing 54 by bearings 59. The tubular rotatable shaft 58 can be rotated about its own axis by the air motor 56. The coating gun 16 also has a rotary atomizing head 60 integrally mounted on the tip end of the tubular rotatable shaft 58 and a hub 64 mounted on an inner wall surface 62 of the rotary atomizing head 60.

The dual-tube nozzle 49 with the inner tube 50 disposed coaxially in the outer tube 52 is housed in the rotatable shaft 58. The inner tube 50 has a tip end 50*a* projecting a certain length forward from the tip end 52*a* of the outer tube 52. The inner tube 50 has a hardener passage 66 defined therein which can communicate with the hardener supply passage 24. The inner tube 50 and the outer tube 52 define a base component passage 68 defined therebetween which can communicate with the base compound supply passage 18.

Figure 3:
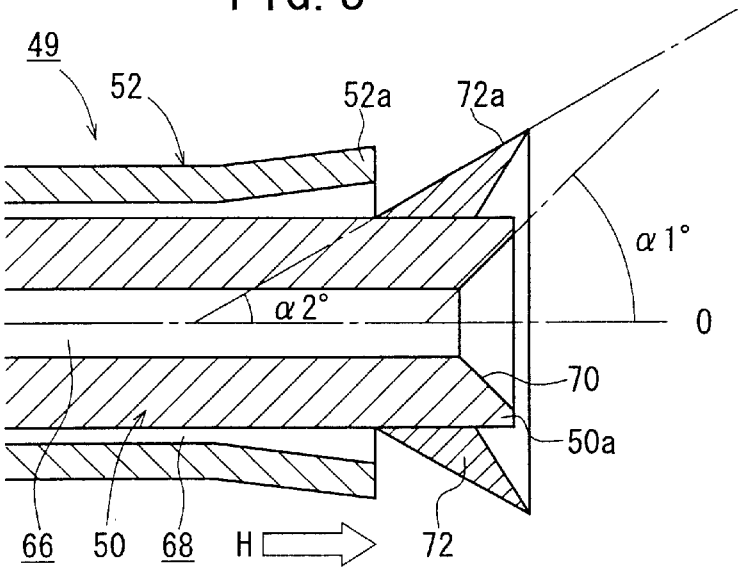
FIG. 3 is a cross-sectional view of a dual-tube nozzle of the coating gun shown in FIG. 2.

As shown in FIG. 3, the tip end 50*a* of the inner tube 50 has an inner tapered surface 70 defining a tapered hole which is progressively larger in diameter in the forward direction, indicated by the arrow H, of the tip end 50*a*. The tapered surface 70 is inclined to the axis O of the dual-tube nozzle 49 by an angle $\alpha°1$ that is referred to as a liquid emission angle through which the hardener 22 is discharged from the inner tube 50 into the rotary atomizing head 60. The tip end 50*a* has a conical element 72 mounted on its outer circumferential surface and having a diameter progressively larger in the forward direction. The conical element 72 has an outer tapered surface 72*a* inclined to the axis O by an angle $\alpha°2$ that is also referred to as a liquid emission angle through which the base compound 14 is discharged into the rotary atomizing head 60.

The angle $\alpha°1$ for discharging the hardener 22 into the rotary atomizing head 60 is larger than the angle $\alpha°2$ for discharging the base compound 14 into the rotary atomizing head 60. In the first embodiment, the angle $\alpha°1$ is set to 45° and the angle $\alpha°2$ to 30°. The tip end 52*a* of the outer tube 52 is of a tapered shape which is progressively larger in diameter in the forward direction.

As shown in FIG. 1, the coating gun 16 is connected to a third cleaning valve 74 and a fourth cleaning valve 76, and is also connected to drain pipes 78*a*, 78*b*. Drain pipes 80*a*, 80*b* are connected respectively to the drain valves 48*a*, 48*b*.

Operation of the two-package-mixing coating device 10 will be described below.

In the first and second color changing valve mechanisms 12, 20, the control valves 28*a*, 32*a*, for example, are opened to deliver the base compound 14 and the hardener 22 which correspond to a certain coating under pressure from the first and second color changing valve mechanisms 12, 20 to the base compound supply passage 18 and the hardener supply passage 24.

The base compound 14 and the hardener 22 are supplied to the first and second color changing valve mechanisms 12, 20 under a pressure ranging from 0.5 MPa to 0.6 MPa. Before the base compound 14 and the hardener 22 are supplied to the first and second gear pumps 34, 36, the pressure thereof is adjusted to a certain pressure, e.g., a low pressure ranging from 0.05 MPa to 0.2 MPa by the first and second pressure control valves 38, 40. Thereafter, the base compound 14 and the hardener 22 are supplied to the first and second gear pumps 34, 36.

The first and second gear pumps 34, 36 are actuated by the respective first and second servomotors 42, 44 to deliver the base compound 14 and the hardener 22 at respective rates downstream through the base compound supply passage 18 and the hardener supply passage 24. The trigger valves 46*a*, 46*b* are opened to supply the base compound 14 and the hardener 22 respectively to the base component passage 68 and the hardener passage 66 (see FIG. 1).

As shown in FIG. 2, the air motor 56 of the coating gun 16 is energized to rotate the shaft 58 supported by the bearings 59, rotating the rotary atomizing head 60 integrally mounted on the shaft 58.

The first gear pump 34 is arranged to discharge the base component 14 at a rate of 2 cc per revolution. The second gear pump 36 is arranged to discharge the hardener 22 at a rate of 0.5 cc per revolution. Since the base compound 14 and the hardener 22 are supplied to the first and second color changing valve mechanisms 12, 20 under a relatively high pressure ranging from 0.5 MPa to 0.6 MPa, if the base compound 14 and the hardener 22 were directly supplied to the first and second gear pumps 34, 36, then the base compound 14 and the hardener 22 would be discharged from the first and second gear pumps 34, 36 at rates higher than the rates that are preset by the rotational speeds of the first and second gear pumps 34, 36.

If the base compound 14 and the hardener 22 were supplied to the first and second gear pumps 34, 36 under a relatively low pressure, then the base compound 14 and the hardener 22 would not be discharged from the first and second gear pumps 34, 36 at desired rates.

According to the first embodiment, the first and second pressure control valves 38, 40 are interposed between the first and second color changing valve mechanisms 12, 20 and the first and second gear pumps 34, 36. The first and second pressure control valves 38, 40 adjust the pressures of the base compound 14 and the hardener 22, which are supplied to the first and second color changing valve mechanisms 12, 20 under the relatively high pressure ranging from 0.5 MPa to 0.6 MPa, to the low pressure ranging from 0.05 MPa to 0.2 MPa, and then deliver the base compound 14 and the hardener 22 under the adjusted pressures to the first and second gear pumps 34, 36.

The base compound 14 and the hardener 22 are supplied under the desired pressures to inlet ports of the first and second gear pumps 34, 36. The first and second gear pumps 34, 36 then discharge the base compound 14 and the hardener 22, respectively, at desired rates. Consequently, the base compound 14 and the hardener 22 are mixed with each other reliably at a desired mixing ratio without mixing ratio variations.

According to the first embodiment, therefore, the base compound 14 and the hardener 22 are discharged from the coating gun 16 at a constant rate to coat an object such as an automotive body with a coating having stable properties such as color, hardness, etc.

The first and second pressure control valves 38, 40 are capable of changing the pressures under which they deliver the base compound 14 and the hardener 22, depending on the type of the coating to be applied. Particularly, different types of hardeners 22 have widely different viscosities, and any variations in the pressure under which the hardener 22 is discharged from the coating gun 16 can effectively be minimized by changing the pressure under which the second pressure control valve 40 delivers the hardener 22, depending on the type of the hardener 22 that is used.

In the first embodiment, as shown in FIG. 3, the tapered surface 70 provides the liquid emission angle $\alpha°1$ for the hardener 22 with respect to the axis O at the tip end of the hardener passage 66 in the inner tube 50. The conical element 72 provides the liquid emission angle $\alpha°2$ for the base compound 14 with respect to the axis O at the tip end of the base component passage 68 defined between the inner tube 50 and the outer tube 52. The liquid emission angle $\alpha°1$ is greater than the liquid emission angle a $\alpha°2$.

Figure 4:
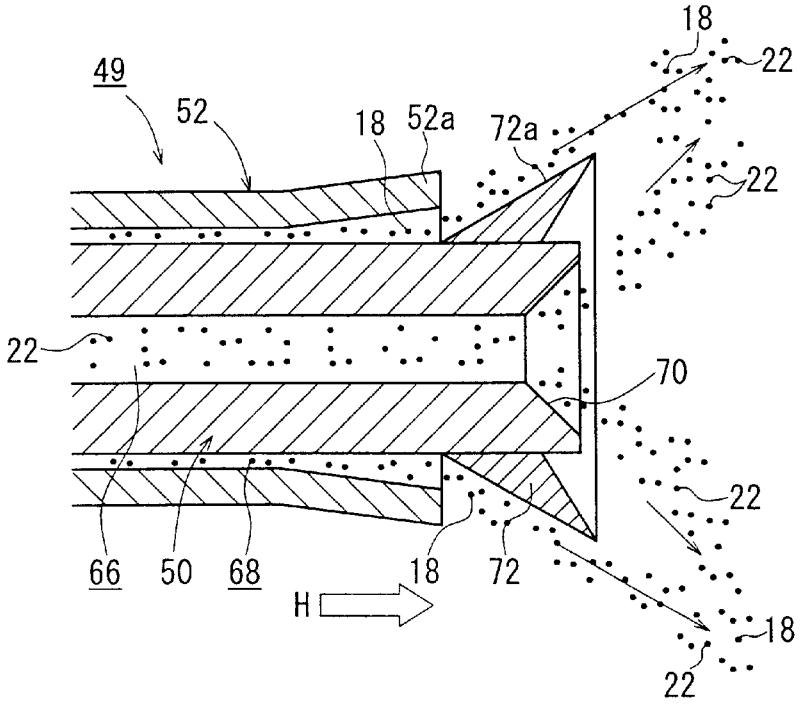
FIG. 4 is a cross-sectional view showing the manner in which the dual-tube nozzle shown in FIG. 3 operates.

As shown in FIG. 4, the hardener 22 discharged from the tip end of the hardener passage 66 and the base compound 14 discharged from the tip end of the base component passage 68 are directly aerially mixed with each other, and then supplied into the rotary atomizing head 60. When the rotary atomizing head 60 rotates, it atomizes and discharges the mixture of coating toward the object to be coated. In the mixture of coating, the base compound 14 and the hardener 22 are mixed with each other reliably at a desired mixing state (mixing ratio), providing desired properties of the coating applied to the object.

According to the first embodiment, furthermore, the hardener passage 66 defined in the inner tube 50 of the dual-tube nozzle 49 is supplied with the hardener 22, and the base compound passage 68 defined between the inner tube 50 and the outer tube 52 is supplied with the base compound 14. The base compound 14 is made of acrylic resin, urethane, polyester urethane, acrylic urethane, or the like, and is less liable to change its viscosity upon exposure to air and water. The hardener 22 is made of isocyanate, for example, and quickly hardens when it contacts air and water.

In a structure wherein the inner passage in the dual-tube nozzle 49 is supplied with the base compound 14 and the outer passage in the dual-tube nozzle 49 is supplied with the hardener 22, the hardener 22 would tend to be attached to and hardened on the tip end 50*a* of the inner tube 50, and be discharged at varying rates and directions, resulting in unstable properties of the produced coating.

According to the first embodiment, the inner tube 50 is supplied with the hardener 22, and the space between the inner tube 50 and the outer tube 52 is supplied with the base compound 14. Therefore, the hardener 22 is prevented from being attached to and hardened on the outer surface of the tip end 50*a* of the inner tube 50, thus effectively maintaining a stable coating process for coating the desired object.

After a coating process performed by the coating gun 16 is finished, the inner tube 50 of the dual-tube nozzle 49 is cleaned if a relatively long interval is present until a next coating process is carried out. Specifically, after the supply of the base compound 14 and the hardener 22 is stopped, the second cleaning valve 30 of the second color changing valve mechanism 20 is opened to deliver a cleaning liquid to the hardener supply passage 24. At this time, the first gear pump 34 is inactivated and the second gear pump 36 is actuated to send the cleaning liquid under pressure to the hardener supply passage 24, from which the cleaning liquid is introduced into the hardener passage 66 of the coating gun 16. The cleaning liquid flows through the hardener passage 66 to clean the inner surface of the inner tube 50, and is then discharged from the tip end of the rotary atomizing head 60.

After the inner tube 50 is cleaned, the second cleaning valve 30 of the second color changing valve mechanism 20 is closed, and the control valve 32*a,* for example, is opened. The second gear pump 36 is actuated to deliver the hardener 22 under pressure into the hardener supply passage 24 to fill the hardener supply passage 24 with the hardener 22. After the hardener supply passage 24 is filled with the hardener 22, the first and second gear pumps 34, 36 are actuated to supply the base compound passage 68 and the hardener passage 66 with the base compound 14 and the hardener 22, respectively. The base compound 14 and the hardener 22 are aerially mixed with each other, and then supplied into the rotary atomizing head 60. Therefore, the base compound 14 and the hardener 22 are well mixed with each other. The mixture is applied to the object, starting the next coating process to coat the object.

In the first embodiment, the inner surface of the inner tube 50 is cleaned by the cleaning liquid that is supplied via the second cleaning valve 30 of the second color changing valve mechanism 20. However, the inner surface of the inner tube 50 may be cleaned by the cleaning liquid that is supplied via the third cleaning valve 74.

When coating colors are changed, the base compound supply passage 18 and the hardener supply passage 24 are cleaned by a cleaning liquid supplied via the first and second cleaning valves 26, 30. At this time, the pressure of the cleaning liquid supplied via the first and second cleaning valves 26, 30 is controlled at a relatively high level of about 0.5 MPa by the first and second pressure control valves 38, 40. The cleaning liquid whose pressure is thus regulated is effective to clean the base compound supply passage 18 and the hardener supply passage 24 efficiently.

In the first embodiment, the inner passage (hardener passage 66) of the dual-tube nozzle 49 is supplied with the hardener 22, and the outer passage (base compound passage 68) of the dual-tube nozzle 49 is supplied with the base compound 14. Conversely, however, the inner passage of the dual-tube nozzle 49 may be supplied with the base compound 14, and the outer passage of the dual-tube nozzle 49 may be supplied with the hardener 22. Because the liquid emission angle for liquid emission from the inner tube 50 is larger than the liquid emission angle for liquid emission from the space between the inner tube 50 and the outer tube 52, the base compound 14 and the hardener 22 are well mixed with each other and supplied into the rotary atomizing head 60. The base compound 14 and the hardener 22 remain well mixed with each other as they are applied to the object to efficiently produce a high-quality coating on the object.

In the first embodiment, the coating device 10 has been described as a two-package-mixing discharging device. However, the principles of the present invention are also applicable to any device for mixing two liquids individually delivered under pressure and discharging the mixture.

Figure 5:
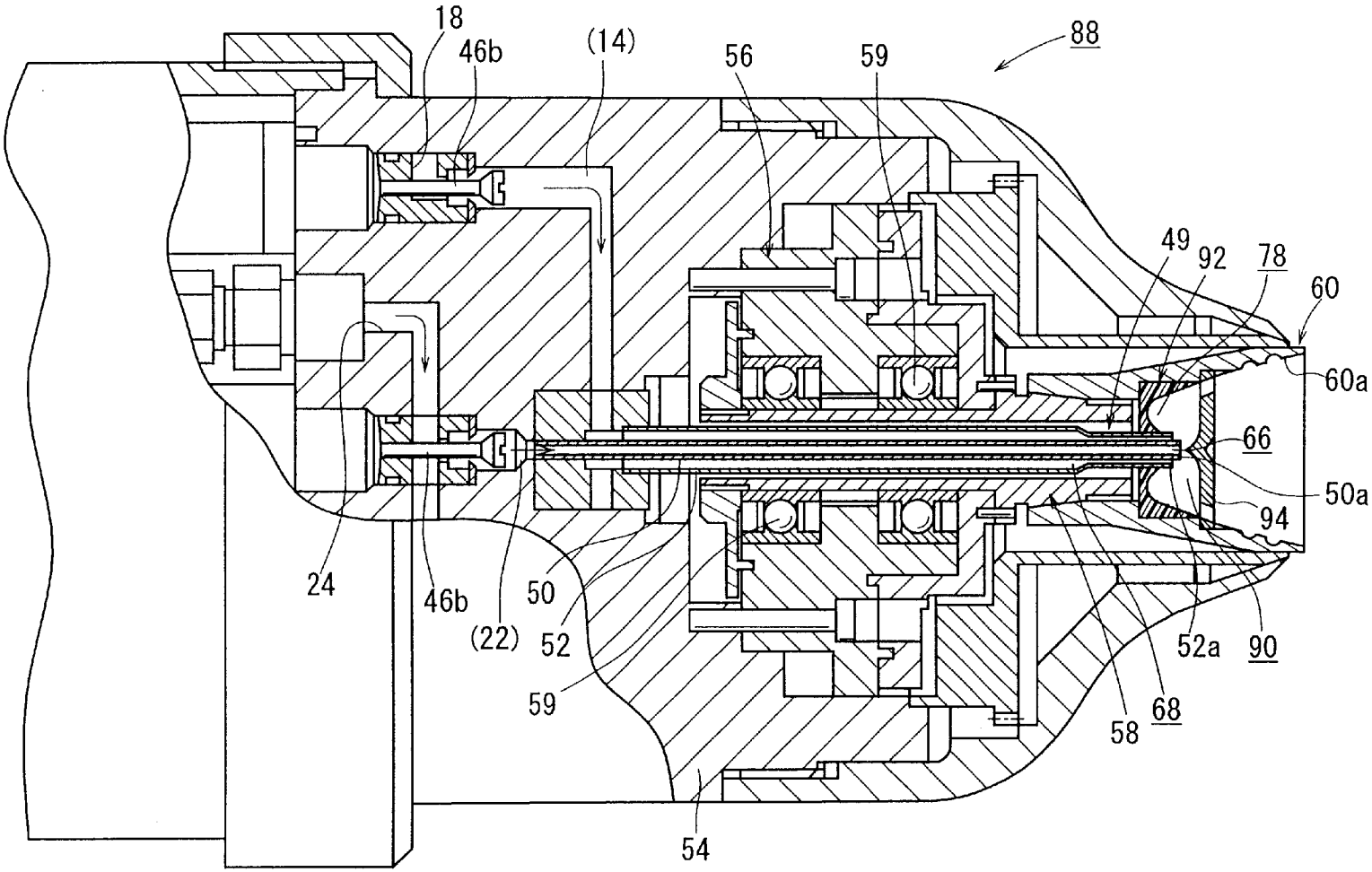
FIG. 5 is a fragmentary cross-sectional view of a coating gun of a two-package-mixing coating device according to a second embodiment of the present invention.

FIG. 5 shows in fragmentary cross section a coating gun 88 of a two-package-mixing coating device according to a second embodiment of the present invention. Those parts of the coating gun shown in FIG. 5 which are identical to those of the coating device 10 according to the first embodiment are denoted by identical reference characters, and will not be described in detail below.

Figure 6:
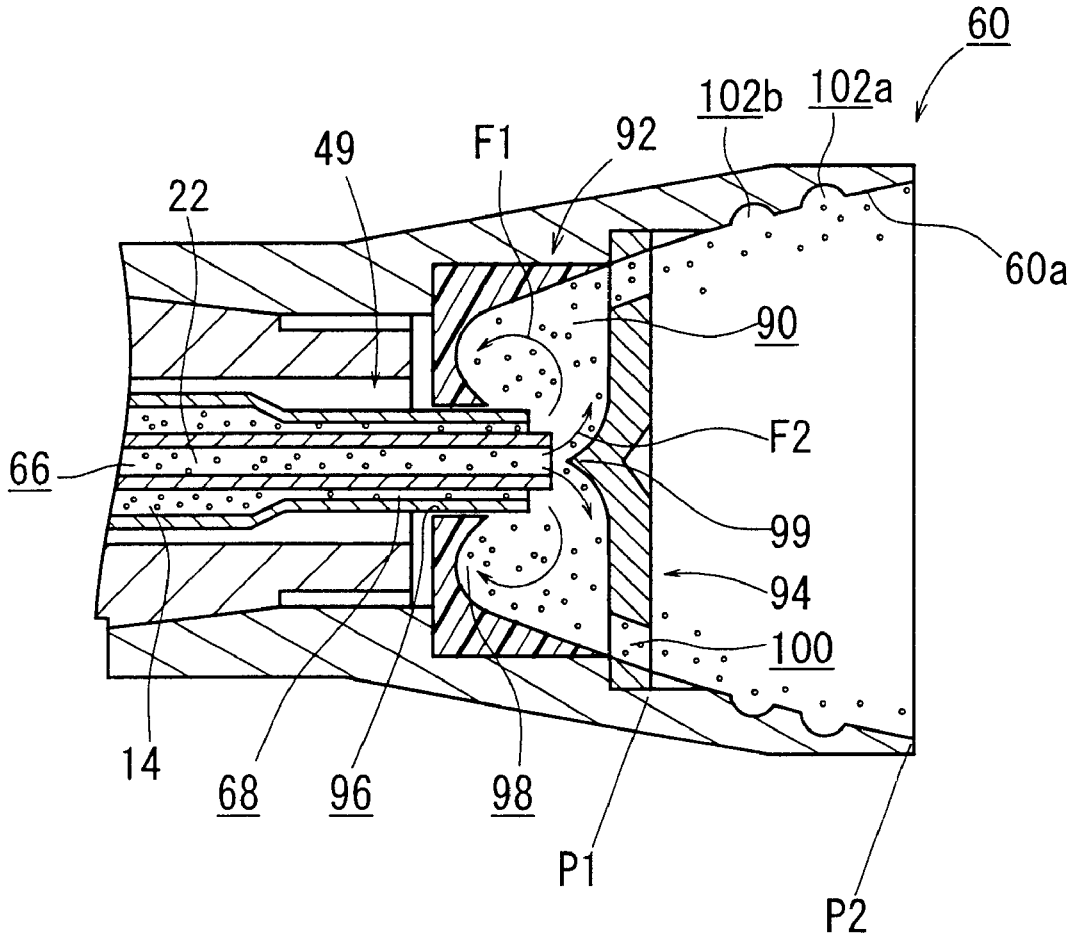
FIG. 6 is a cross-sectional view of a dual-tube nozzle and a rotary atomizing head of the coating gun shown in FIG. 5.
Figure 7:
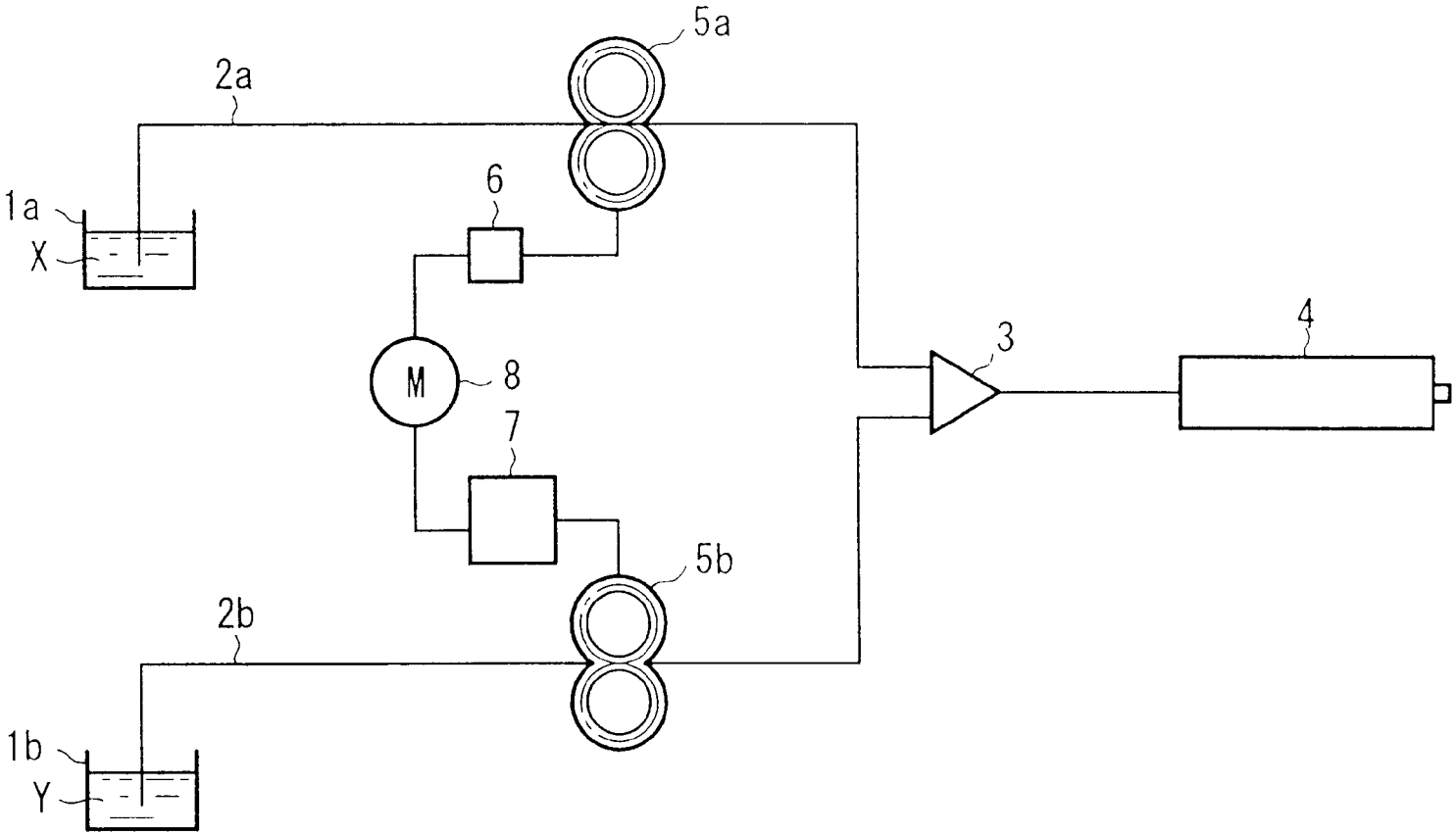
FIG. 7 PRIOR ART
FIG. 7 is a schematic view of a conventional two-package-mixing supplying device.
Figure 8:
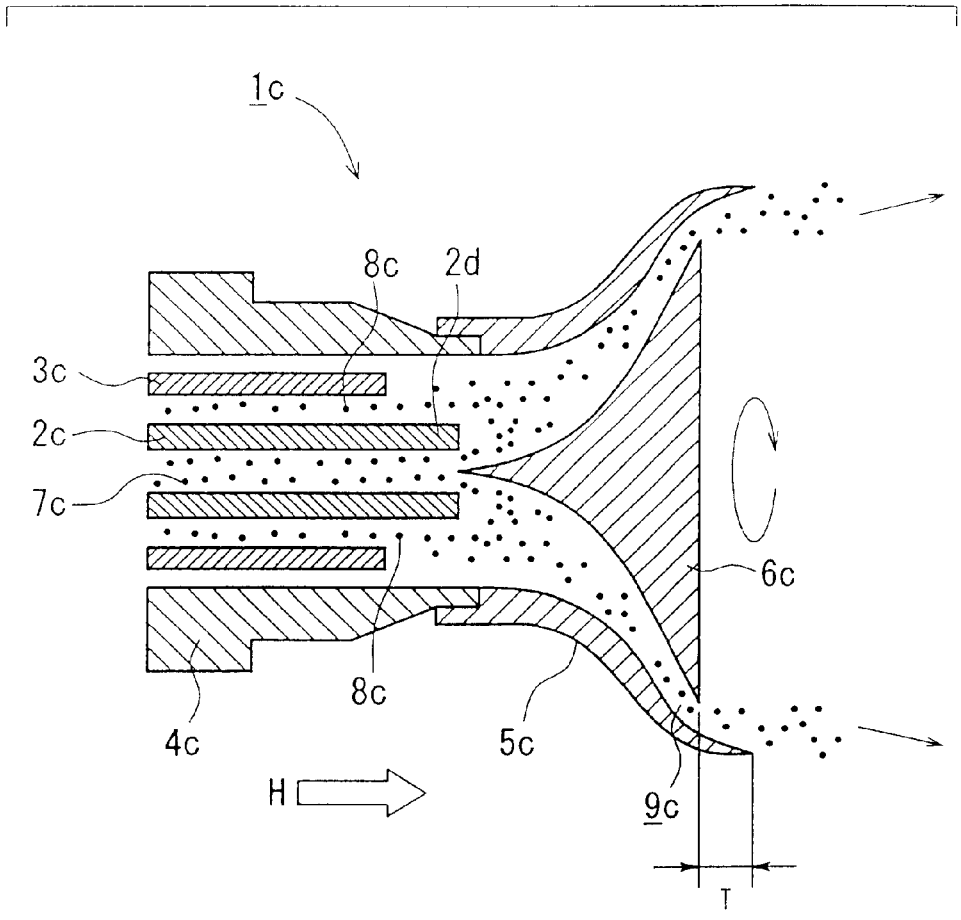
FIG. 8 PRIOR ART
FIG. 8 is a cross-sectional view of a coating gun of a conventional two-package-mixing coating device.

The coating gun 88 has a rotary atomizing head 60 housing therein a cup-shaped member 92 of synthetic resin and a lid 94 which are supported on an inner wall surface 60*a* of the rotary atomizing head 60. The lid 94 is positioned on an open side of the cup-shaped member 92, defining a coating liquid dispersion opening 90 in the cup-shaped member 92 where the tip end of the dual-tube nozzle 49 is open. As shown in FIG. 6, the cup-shaped member 92 has a hole 96 defined centrally in its bottom and through which the dual-tube nozzle 49 extends. The cup-shaped member 92 also has a liquid reservoir 98 positioned deeply in the opening 90 inwardly of the tip end of the dual-tube nozzle 49.

The lid 94 is substantially in the shape of a disk and has a pointed coating liquid guide protrusion 99 on its surface facing the dual-tube nozzle 49. The lid 94 also has a plurality of through holes or arcuate slots 100 defined in an outer circumferential edge portion thereof and arranged at spaced intervals in a circular pattern.

The inner wall surface 60*a* of the rotary atomizing head 60 has two circumferential grooves 102*a,* 102*b* defined therein. The lid 94 is mounted on the inner wall surface 60*a* at a position P1, and the tip end of the rotary atomizing head 60 is located at a position P2. The distance along the inner surface configuration (with surface irregularities) of the inner wall surface 60*a* including the circumferential grooves 102*a,* 102*b* from the position P1 to the position P2 is represented by L (mm). The product of L×N where N is the rotational speed (rpm) of the rotary atomizing head 60 is set to a range from 400,000 to 900,000. Specifically, the rotational speed N of the rotary atomizing head 60 is in the range from 20,000 rpm to 30,000 rpm, and the distance L is in the range from 20 mm to 30 mm.

As shown in FIG. 6, the lid 94 is mounted in the rotary atomizing head 60, and the distance L (mm) along the inner surface configuration from the lid 94 to the tip end of the rotary atomizing head 60, i.e., from the position P1 to the position P2, is preset in relation to the rotational speed N (rpm) of the rotary atomizing head 60. Specifically, as described above, the product of the distance L and the rotational speed N is in the range from 400,000 to 900,000. Since the rotational speed N of the rotary atomizing head 60 is in the range from 20,000 rpm to 30,000 rpm, the distance L is in the range from 20 mm to 30 mm.

The base compound 14 and the hardener 22 that are individually emitted from the dual-tube nozzle 49 into the opening 90 are mixed with each other reliably at a desired mixing state (mixing ratio). Therefore, the mixture atomized and discharged from the rotary atomizing head 60 to the object (not shown) to be coated is reliably maintained in the desired mixing state, efficiently producing a high-quality coating of stable properties free of coating irregularities and hardness variations on the object.

If the distance L were smaller than 20 mm when the rotational speed N of the rotary atomizing head 60 is in the range from 20,000 rpm to 30,000 rpm, the distance L would be too small, causing the base compound 14 and the hardener 22 to be mixed irregularly and tending to develop color and hardness irregularities in the produced coating on the object. Conversely, if the distance L were greater than 30 mm when the rotational speed N of the rotary atomizing head 60 is in the range from 20,000 rpm to 30,000 rpm, the distance L would be too large, causing the base compound 14 and the hardener 22 to be dried and tending to lower the efficiency with which they are deposited on the object and bring about discolorations. With the rotational speed N and the distance L set in the ranges described above, a highly accurately coating can efficiently be produced on the object.

In the second embodiment, the liquid reservoir 98 is positioned deeply in the opening 90 inwardly of the tip end of the dual-tube nozzle 49. The base compound 14 and the hardener 22 expelled from the dual-tube nozzle 49 are mixed along mixture flows F1 in the liquid reservoir 98, and thereafter impinge upon mixture flows F2 that do not enter the liquid reservoir 98.

Upon such flow impingement, the base compound 14 and the hardener 22 are further mixed together into a desired mixing state. Therefore, the rotary atomizing head 60 atomizes and expels the accurately produced mixture of the base compound 14 and the hardener 22, applying a highly accurately coating reliably to the object.

The two-package-mixing discharging device according to the present invention has pressure control means disposed in the first and second liquid supply passages for supplying first and second liquids to the discharger, upstream of the first and second gear pumps. The pressure control means serve to control the pressures of the first and second liquids supplied to the first and second gear pumps at desired pressures. Thus, the first and second gear pumps can discharge the first and second liquids, respectively, under pressure at constant rates, without changing the mixing ratio of the first and second liquids. Therefore, it is possible for the rotary atomizing head to discharge the first and second liquids mixed at the desired mixing ratio.

The two-package-mixing coating device according to the present invention has the dual-tube nozzle which is individually supplied with the base compound and the hardener, each in the form of a liquid. The liquid emission angle for liquid emission from the inner tube of the dual-tube nozzle is larger than the liquid emission angle for liquid emission from the space between the inner tube and the outer tube. Accordingly, the base compound and the hardener are aerially mixed with each other, and then supplied into the rotary atomizing head.

The mixing state of the base compound and the hardener is thus effectively improved with the simple arrangement, and the mixture of the base compound and the hardener is atomized and discharged at a desire mixing ratio to the object to be coated, efficiently producing a high-quality coating on the object.

The two-package-mixing coating device according to the present invention has the dual-tube nozzle which is individually supplied with the base compound and the hardener, and the product L×N where L represents the distance (mm) from the lid to the tip end of the rotary atomizing head along the inner surface configuration of the rotary atomizing head and N represents the rotational speed (rpm) of the rotary atomizing head is in the range from 400,000 to 900,000. This simple structure is effective to improve the mixing state of the base compound and the hardener, atomize and discharge the mixture of the base compound and the hardener at a desired mixing ratio to the object, and produces a high-quality coating on the object.

Although certain preferred embodiments of the present invention have been shown and described in detail, it should be understood that various changes and modifications may be made therein without departing from the scope of the appended claims.

What is claimed is:

1. A two-package-mixing discharging device for supplying two liquids individually fed under pressure to a discharger and discharging a mixture of the liquids from the discharger, comprising:

a first liquid supply passage for supplying the first liquid fed under pressure from a first liquid supply to said discharger; and a second liquid supply passage for supplying the second liquid fed under pressure from a second liquid supply to said discharger;

said first and second liquid supply passages having:

first and second gear pumps for delivering said first and second liquids under pressure to said discharger; and liquid pressure control means disposed upstream of said first and second gear pumps, respectively, for controlling said first and second liquids to be supplied to said first and second gear pumps, respectively, under respective predetermined pressures, wherein said liquid pressure control means comprise first and second pressure control valves disposed respectively in said first and second liquid supply passages.

2. A two-package-mixing discharging device according to claim 1, wherein said first and second liquid supplies comprising:

first and second cleaning valves, respectively, for controlling the supply of air and a cleaning liquid; and a plurality of control valves, for supplying base compounds as said first liquid which correspond to coating liquids of different colors and hardeners as said second liquid which correspond to coating liquids of different colors.

3. A two-package-mixing coating device for mixing, atomizing, and discharging a base compound and a hardener to an object to be coated, comprising:

a rotary atomizing head for atomizing a mixture of the base compound and the hardener; and a dual-tube nozzle disposed in said rotary atomizing head and having an outer tube and an inner tube extending in said outer tube, for individually supplying the base compound and the hardener, and mixing, atomizing, and discharging the base compound and the hardener to an object to be coated;

said inner tube being arranged to emit a liquid at a liquid emission angle greater than a liquid emission angle for liquid emission from a space between said inner tube and said outer tube, so that the base compound and said hardener emitted from said dual-tube nozzle can be aerially mixed with each other and supplied into said rotary atomizing head.

4. A two-package-mixing coating device according to claim 3, wherein said inner tube defines a hardener passage therein for being supplied with said hardener, and said inner tube and said outer tube define a base compound passage therebetween for being supplied with said base compound.

5. A two-package-mixing coating device according to claim 3, wherein said inner tube has a tapered surface on a tip end thereof which defines a tapered hole which is progressively larger in diameter in a forward direction toward a tip end of the rotary atomizing head, said tip end having a conical element disposed on an outer circumferential surface thereof and having a diameter progressively larger in said forward direction, said tapered surface being inclined to an axis of said dual-tube nozzle at an angle $\alpha°1$ which is greater than an angle $\alpha°2$ formed between an outer surface of said conical element and said axis of said dual-tube nozzle.

6. A two-package-mixing coating device according to claim 5, wherein said outer tube has a tip end of a tapered shape which is progressively larger in diameter toward said conical element.

7. A two-package-mixing coating device for mixing, atomizing, and discharging a base compound and a hardener to an object to be coated, comprising:

a rotary atomizing head for atomizing a mixture of the base compound and the hardener;

a dual-tube nozzle disposed in said rotary atomizing head and having an outer tube and an inner tube extending in said outer tube, for individually supplying the base compound and the hardener, mixing and atomizing the base compound and the hardener in said rotary atomizing head, and discharging the atomized mixture of the base compound and the hardener from said rotary atomizing head to an object to be coated; and a lid disposed in said rotary atomizing head and defining a coating liquid dispersion opening, wherein tip ends of said outer tube and said inner tube of said dual-tube nozzle both open in said coating liquid dispersion opening facing said lid;

said rotary atomizing head having a tip end spaced from said lid by a distance L (mm) along an inner surface configuration of the rotary atomizing head, said rotary atomizing head being rotatable at a rotational speed N (rpm), the product L×N of said distance L and said rotational speed N being in a range from 400,000 to 900,000.

8. A two-package-mixing coating device according to claim 7, wherein said rotary atomizing head has a liquid reservoir disposed deeply in said coating liquid dispersion opening inwardly of the tip end of said dual-tube nozzle.

9. A two-package-mixing coating device according to claim 8, further comprising:

a synthetic resin member mounted on an inner wall surface of said rotary atomizing head, said liquid reservoir being defined in said synthetic resin member.

10. A two-package-mixing coating device according to claim 7, wherein said lid is substantially in the shape of a disk and has a coating liquid guide protrusion on a surface thereof facing said dual-tube nozzle.

* * * * *